US007089670B2

(12) United States Patent
Donnerdal

(10) Patent No.: US 7,089,670 B2
(45) Date of Patent: Aug. 15, 2006

(54) PORTABLE MOTOR CHAIN SAW

(75) Inventor: Ove Donnerdal, Sävedalen (SE)

(73) Assignee: Aktiebolaget Electrolux (Publ), Stockholm (SE)

( * ) Notice: Subject to any disclaimer, the term of this patent is extended or adjusted under 35 U.S.C. 154(b) by 25 days.

(21) Appl. No.: 10/490,306

(22) PCT Filed: Sep. 16, 2002

(86) PCT No.: PCT/SE02/01653

§ 371 (c)(1),
(2), (4) Date: Sep. 16, 2004

(87) PCT Pub. No.: WO03/041921

PCT Pub. Date: May 22, 2003

(65) Prior Publication Data

US 2005/0022393 A1 Feb. 3, 2005

(30) Foreign Application Priority Data

Sep. 21, 2001 (SE) ..... 0103149

(51) Int. Cl.
*B27B 17/02* (2006.01)
*B28D 1/08* (2006.01)

(52) U.S. Cl. ..... 30/371; 30/382; 30/383; 125/21

(58) Field of Classification Search ..... 30/371, 30/381, 382, 383, 123.3, 123.4; 125/21
See application file for complete search history.

(56) References Cited

U.S. PATENT DOCUMENTS 3,364,580 A * 1/1968 Lucia ..... 33/630
3,636,996 A * 1/1972 Lanz ..... 30/371
5,016,355 A * 5/1991 Gassen et al. ..... 30/383
5,099,580 A * 3/1992 Stegall et al. ..... 30/383
5,101,567 A * 4/1992 Cool ..... 30/382
5,850,696 A * 12/1998 Sciarrone ..... 30/382
5,901,457 A * 5/1999 Harding ..... 33/630
6,186,136 B1 * 2/2001 Osborne ..... 125/21
6,442,841 B1 * 9/2002 Nilsson et al. ..... 30/123.3
6,701,628 B1 * 3/2004 Mang ..... 30/384

FOREIGN PATENT DOCUMENTS

EP 0 517 447 A1 12/1992
EP 0 940 232 A2 9/1999
EP 1 125 707 A2 8/2001

* cited by examiner

*Primary Examiner*—Hwei-Siu C. Payer
(74) *Attorney, Agent, or Firm*—Nixon & Vanderhye

(57) ABSTRACT

A portable motor chain saw comprises a machine body (1) which a driving unit, a rear handle (2), a front handle which extends over the machine body, a guide bar (6), and a dog device (15) provided such that it can be pressed against the object to be worked by means of the machine, said dog device forming a center of rotation for turning the guide bar in the plane of the guide bar. The characterising features are that the dog member (15) is provided in front of the front handle (3), approximately on a level with that part (4) of the front handle which extends over the machine body, and is connected to the front handle, and that at least that part of the dog device which is provided to engage the object to be worked, consists of a polymeric material. Preferably, the height of the dog device over the guide bar corresponds to two to three times the vertical width of the guide bar.

18 Claims, 6 Drawing Sheets

PORTABLE MOTOR CHAIN SAW

This application is the U.S. National Phase of International Application PCT/SE02/01653, filed 16 Sep. 2002, which designated the U.S.

TECHNICAL FIELD

The invention concerns a portable motor chain saw comprising a machine body with a driving unit, a rear handle, a front handle which extends over the machine body, a guide bar, and a dog device provided such that it can be pressed against the object to be worked by means of the machine, said dog device forming a centre of rotation for turning the guide bar in the plane of the guide bar.

BACKGROUND OF THE INVENTION

It is known in the art to provide a device on the front of the machine body, above or below the guide bar, for engagement against the object to be worked by means of the machine, which device shall be able to form a centre of rotation for a turning of the machine for the purpose of augmenting the power pressure of the guide bar and hence of the saw chain against the bottom of the kerf which the saw chain is establishing in the object. In its most elementary design, a dog device of that type according to the prior art consists of a pointed, projecting metal spike on the machine body on a level immediately below or immediately above the guide bar. Also more complicated devices are employed, including a system of parallel links in which affront spike which, when engaging the front side of the object which is being worked, presses the guide bar downwards by means of a spring force, such that the machine need not be turned to achieve an augmentation of the power pressure. The device has evident advantages in theory, but in practice it has substantial deficiencies, mainly because of its design which is easily damaged, and which is difficult to make stronger unless the design is made much more robust and hence also heavier, more cumbersome and more expensive.

BRIEF DESCRIPTION OF THE INVENTION

It is the purpose of the invention to address the above mentioned problems. More particularly, the invention aims at achieving at least some of the below mentioned advantages by means of a dog device located according to the invention, the dog device suitably being designed according to a preferred embodiment of the invention, in order to enhance the pressing force of the saw chain and hence promoting the feed of the saw chain in the working material, particularly in connection with sawing in walls made of concrete, brick, stone or in composite materials by means of diamond equipped saw chains, such as

- long working life of the dog device
- low manufacturing cost
- low weight
- good feed efficiency also when applying a moderate manual pressure force
- direct development of full force by means of the dog device; no mechanically flexible springs
- integrating the dog device with a hand guard for the operator
- devibration of the dog device through selected location
- no damages on the wall, if the wall e.g. is plastered

- possibility to integrate a water valve in the assembly which comprises a hand guard and said dog device according to the preferred embodiment of the invention.

These and other advantages are possible to achieve therein that the invention is characterized in that the dog member is provided in front of the front handle, approximately on a level with that part of the front handle which extends over the machine body, and is connected to the front handle, and that at least that part of the dog device which is provided to engage the object to be worked, consists of a polymeric material. Preferably, the height of the dog device over the guide bar corresponds to two to three times the vertical width of the guide bar.

The above mentioned positioning of the dog device can be achieved in several conceivable ways. Suitably it is provided on a member which projects from the front handle. According to a preferred embodiment of the invention, it is provided on the front side of a hand guard which is rigidly mounted on the front handle, such that it extends at least a bit along and at a distance from that part of the front handle which extends over the machine body. The handle itself is, according to the preferred embodiment, devibratedly connected to the machine body in a mode which may be known per se. Alternatively, the dog device may be devibratedly connected to the front handle, which in that case may be devibratedly or non-devibratedly connected to the machine body.

The motor chain saw is, according to a preferred embodiment of the invention, intended primarily for sawing hard materials, such as stone, concrete, brick, and alike, and is therefore provided with equipment for supply of water to the saw chain and/or to the kerf. For this application, the machine is also provided with a control valve for controlling the water supply. This valve with its control may advantageously be integrated with the hand guard, such that the dog device, the hand guard and the water control valve and the valve control form an integrated unit provided such that the operator with one hand gripping the front handle, protected by the hand guard, may press the dog device against the object to be sawn and at the same time reach the valve control with the same hand.

Further characteristic features and aspects of the invention will be apparent from the appending patent claims and from the following description of a preferred embodiment.

BRIEF DESCRIPTION OF DRAWINGS

In the following detailed description of a preferred embodiment of the invention, reference will be made to the accompanying drawing, in which.

DETAILED DESCRIPTION OF AN EMBODIMENT

Figure 1:
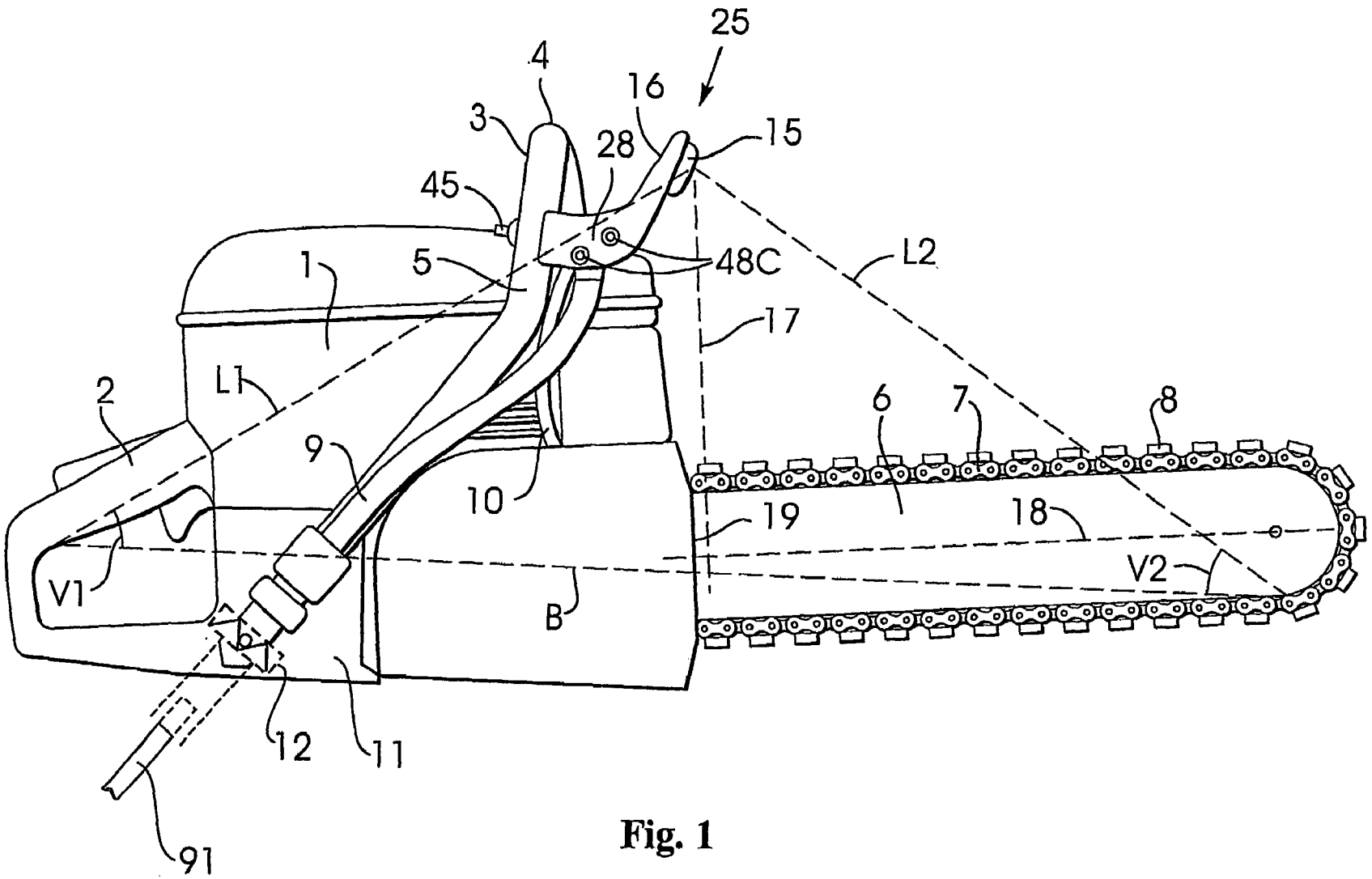
FIG. 1 shows the portable motor chain saw from the right hand side.
Figure 2:
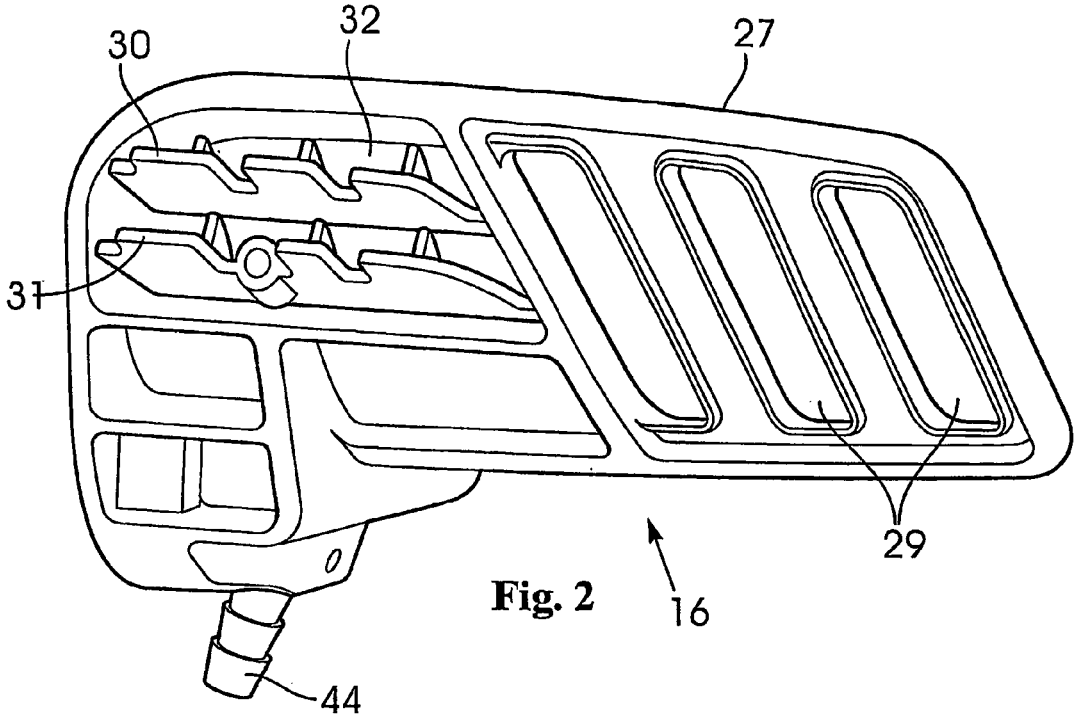
FIG. 2 is a perspective view of a hand guard obliquely from the front.
Figure 3:
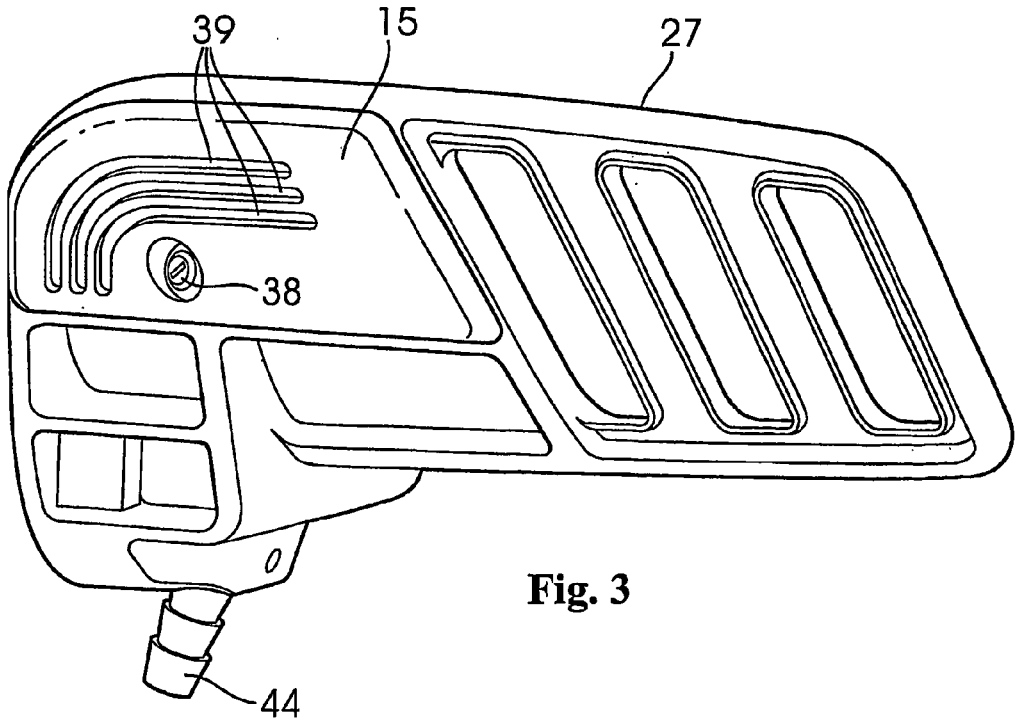
FIG. 3 shows the same hand guard in the same view, wherein the hand guard is provided with a dog device in the form of a rubber body.
Figure 4:
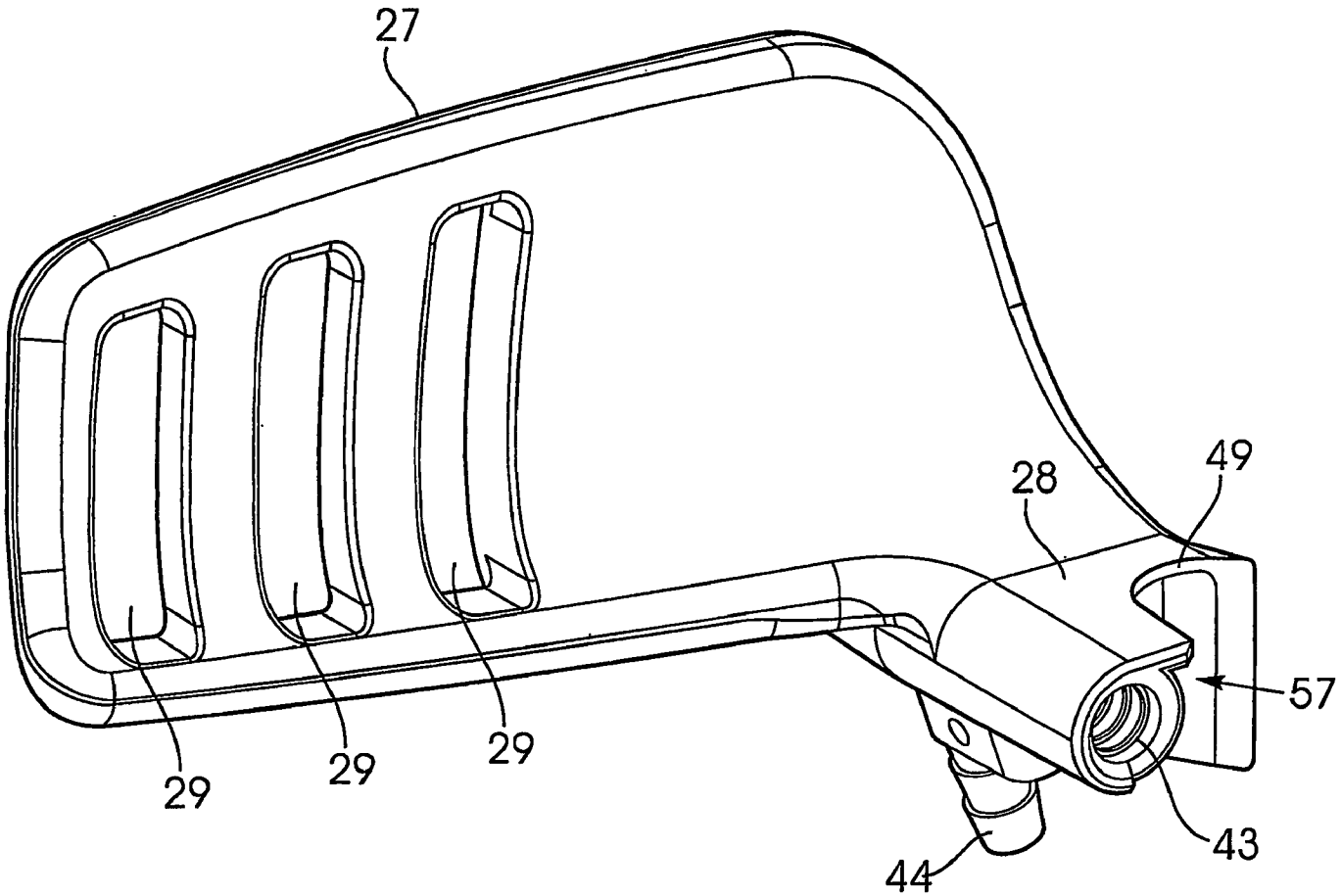
FIG. 4 shows the hand guard obliquely from the rear.
Figure 5:
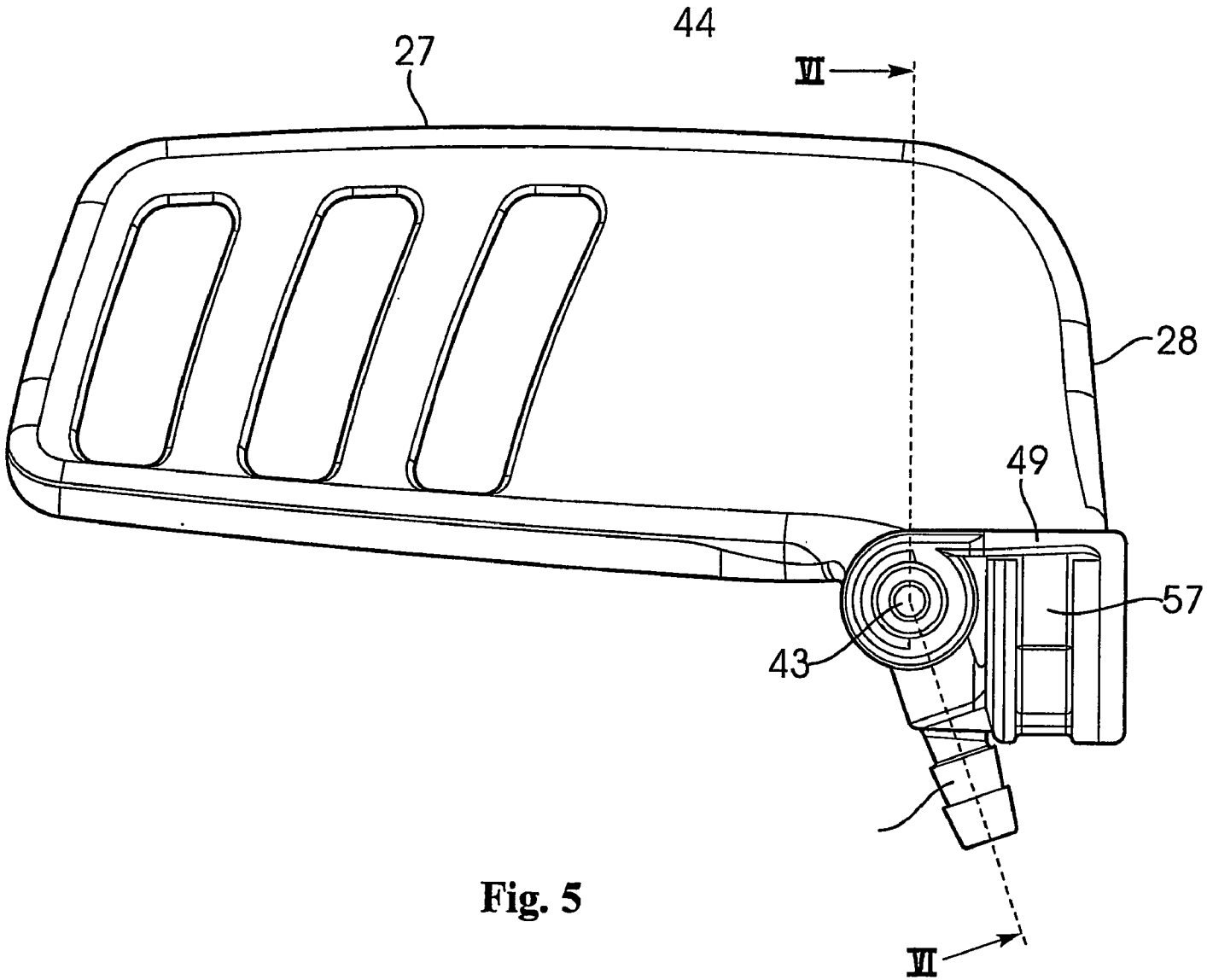
FIG. 5 shows the hand guard straight from the rear.
Figure 6:
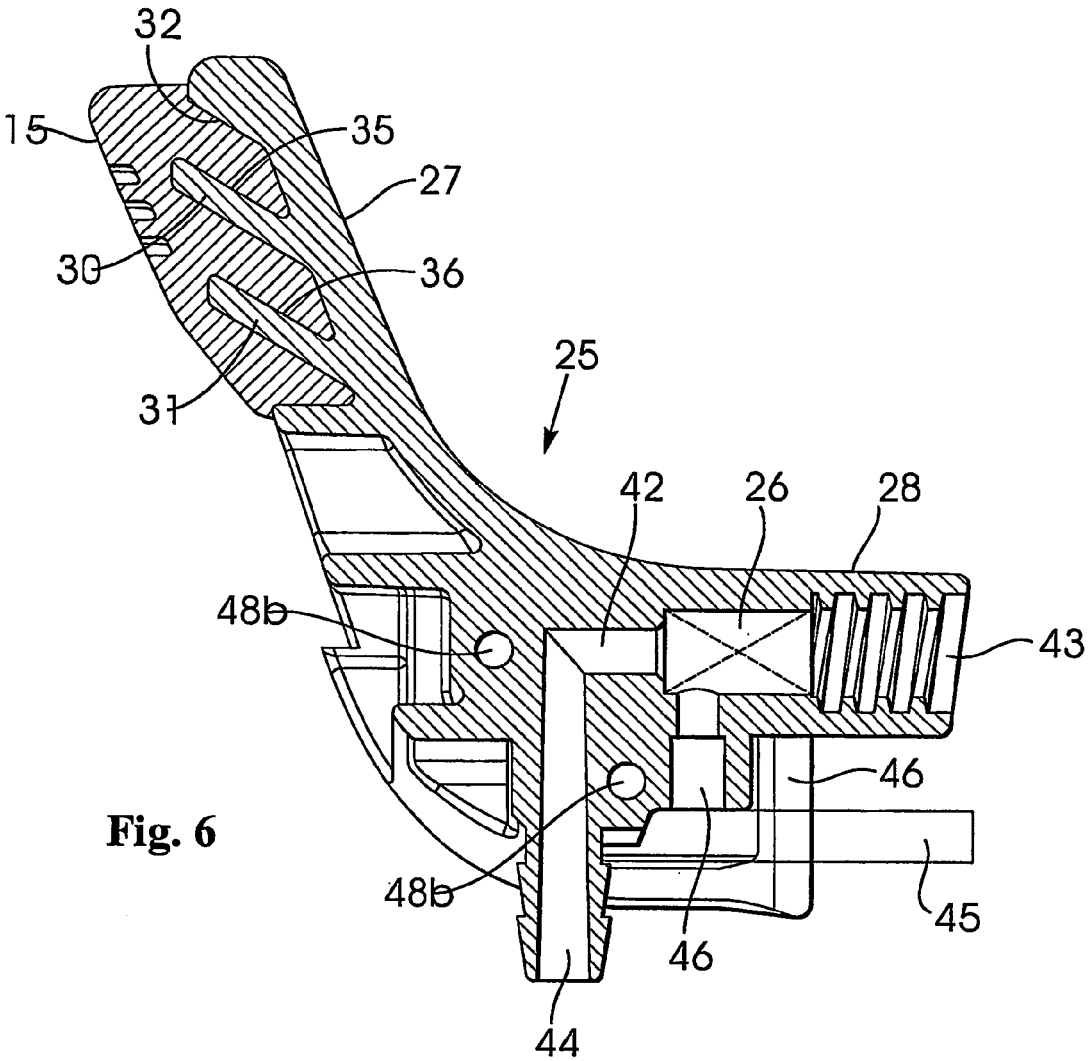
FIG. 6 shows the device according to FIG. 5 in a section along the line VI—VI.

The portable motor chain saw shown in FIG. 1 has a conventional basic design, which comprises the following main parts: a machine body 1 with a drive machinery, a rear handle 2 with a control for controlling the drive machinery, a front handle 3 with a gripping portion 4, which extends over the machine body 1, and a right hand portion 5, which extends along the right hand side of the machine body 1, and a guide bar 6 with a saw chain 7, which according to the invention is provided with diamond equipped links 8 for sawing hard materials such as concrete, brick, stone, and the like. In connection with that type of sawing, supply of water to the saw chain 7 and/or to the kerf is required. Two water-hoses are designated 9 and 10, respectively. The rear handle 2 and the front handle 3 form integrated parts of a unit, generally designated 11, which is devibratedly connected to the machine body 1. A devibration of this kind is part of the prior art and will therefore not be described in any detail. The devibration, however, according to this well known technique may be achieved by means of spring elements, which symbolically are indicated in FIG. 1 by the element 12.

According to the invention, a dog device 15 is provided in front of the front handle approximately on a level with that part 4 of the front handle 3 which extends over the machine body 1, said device being intended to be able to be pressed against the workpiece by means of the machine at a high level above the guide bar. This will be explained more in detail in the following. The device 15 is fastened on the front side of a fixed i.e. immovable, essentially rigid hand guard 16, which in its turn is mounted on the front handle 3. Laterally, the device 15 is located over the guide bar 6 and the chain 7. In the longitudinal direction of the machine, the device 15 is located such that a vertical line 17 from the front side of the device 15 intersects a horizontal plane 18 which coincides with the centre line of the guide bar in the region of, or adjacent to, the plane which is defined by the front side 19 of the machine body in the region of the guide bar, which means that the dog device does not restrict the penetration depth of the saw. The height of the device 15 above the guide bar corresponds to slightly more than double the length of the vertical width of the guide bar.

With given dimensions of the basic design of the machine, including the given length of the guide bar 6, the dog device 15 according to the invention is located at the top of an essentially isosceles triangle having the base B and the sides L1 and L2, which are essentially equally long, where, B=the distance between the rear portion of the rear handle 2 and the lower edge of the guide bar adjacent to the point of the guide bar, L1=the distance between the rear portion of the rear handle 2 and the dog device 15, and L2=the distance between the lower edge of the guide bar adjacent to the bar point and the dog device 15.

Figure 7:
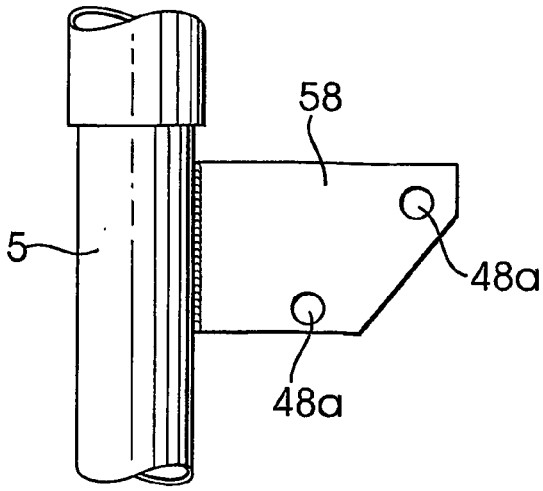
FIG. 7 shows a detail for fastening the hand guard on a section of a front handle of the machine in the same view as FIG. 1 but at a larger scale.

When the above conditions apply, the angles v1 and v2 between the lines B and L1, and between B and L2, respectively, are approximately equally large and amount to about 33° according to the embodiment, or, more generally, to between 25 and 45°, preferably to between 30 and 40°. If the guide bar 6 is longer or shorter than according to the embodiment shown in FIGS. 1 and 7, the lines L1 and L2 will not essentially be equally long and nor will the angles v1 and v2 be equally large. However, the angle v1 also in this case will amount to between 25 and 45°, preferably to between 30 and 40°.

The integrated unit 25 which comprises the dog device 15, the hand guard 16 and a valve 26 with a control 45 for controlling the flow of water through the conduits 9 and 10 now shall be described with reference to FIGS. 2–6.

The hand guard 16 is made of a strong, moulded plastic material, which is very tough and resistant to impact and provides desired stiffness. Its main parts consist of a guard plate 27 and a mounting arm 28. The guard plate 27 is elongated in the horizontal direction and inclined obliquely forwards upwards. The left hand part, which occupies about half the length of the guard plate 27, is provided with a number of material reducing openings 29. On the front side of the right hand part, which adjoins the mounting arm 28, there are provided a pair of elongated, toothed fins 30, 31, which extend forwards upwards from the bottom of a recess 32. The recess 32 and the fins 30, 31 are provided on the front side of the guard plate 27, in its upper, right hand side corner.

The dog device 15 consists of a body of a polymeric material, preferably hard rubber and has a rough surface and/or a high coefficient of friction and a contour matching the recess 32 in the guard plate 27. Further it is provided with recesses 35, 36, FIG. 6, which match the fins 30, 31. In combination with a fixing screw 38, FIG. 3, the fins 30, 31, the grooves 35, 36 and the recess 32 form effective means for stiffening the rubber body 15 and for securing it safely on the front side of the guard plate 27. On the front side the rubber body/dog device 15 is provided with grooves 39.

In the rear end of the mounting arm there is provided a recess 49 which matches the essentially vertical handle portion 5. From the region of the recess 49, a deep securer pocket 57, FIG. 4, extends into the mounting arm. The shape and the depth of this mounting pocket corresponds with the shape and length of a mounting bracket 58, FIG. 7, which has the shape of a steel plate, welded to the essentially vertical handle portion 5. The mounting bracket 58 has two through holes 48*a*. In the mounting arm there are two corresponding upper holes 48*b*. When the hand guard 16 is mounted to the handle portion 5, the recess 49 abuts the handle portion, and the mounting bracket 58 extends into the securer pocket 57, the holes 48*a* and 48*b* being coaxially oriented. The thus mounted hand guard 16 is fixed by means of two screws 48*c*, which are provided with threads for fixing screwing into the plastic material of the mounting arm after having been passed through the holes 48*b* and 48*a*.

The water hoses 9 and 10 are connected to one another via a channel 42, which extends at a right angle through the mounting arm 28 between an inlet 43 for the hose 9 to an outlet 44, connected to the hose 10. In the channel 42 there is a valve 26, which is symbolically shown in FIG. 6, for control of the flow of water. A valve spindle extends through a boring 46 to the control 45, schematically shown in FIG. 6, which faces the operator and is easily reached by the right hand thumb of the operator, when the operator is gripping the upper part 4 of the handle behind the hand guard 16/the guard plate 27. On the front side of the hand guard 16 there are provided a number of recesses and fins beneath the dog device 15 in order to reduce the amount of material and for stiffening the construction, respectively.

Figure 8:
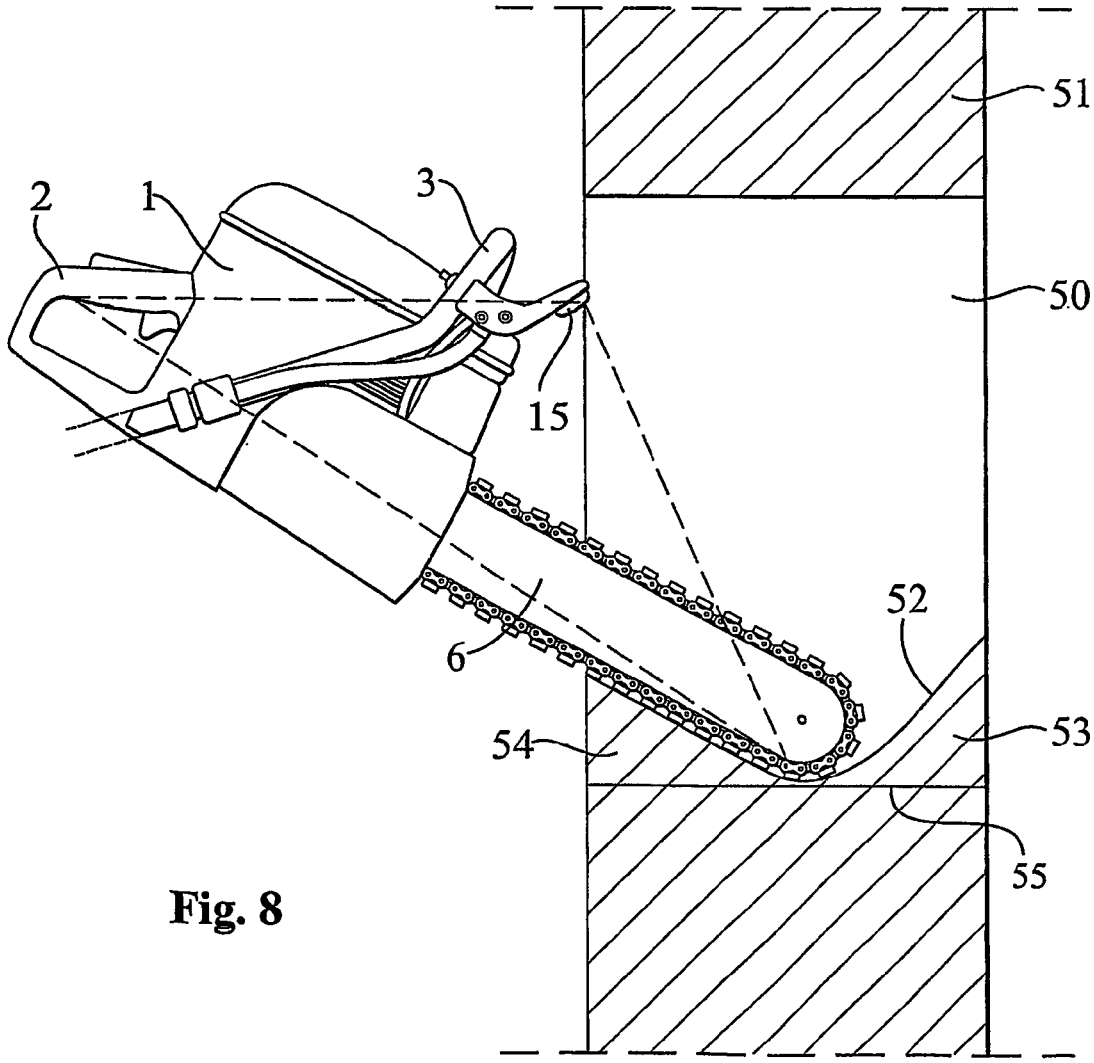
FIG. 8 illustrates a technique for sawing by means of the machine.

The functioning of the machine by means of the dog device 15 now shall be explained with reference to FIG. 8. The provision of an opening in a wall is a typical task for a diamond equipped motor chain saw. By means of the motor chain saw of the invention, it is possible to penetrate a wall having a thickness essentially corresponding to the length of the guide bar, since the dog device 15 is positioned essentially straight over the front wall of the machine body 1 in the region of the guide bar. Once the wall 51 has been penetrated, the bar can be pivoted downwards so that the saw forms a kerf portion, shaped as a segment of a circle in the workpiece, when the operator, who is gripping the upper part of the front handle 3, normally by his left hand, presses the dog device 15 against the wall, at the same time as he with his other hand lifts the rear handle 2 upwards, which causes the front handle 3 to spring slightly back through a spring action in that or those elements which symbolically are indicated by numeral 12 in FIG. 1. By pressing the dog device 15 against the wall, the saw chain 7 is strongly pressed against the bottom of the kerf, wherein the feed of the chain through the workpiece is increased. Because the dog device 15 is mounted via the hand guard 16 on the front handle 3, which is devibratedly connected to the machine body 1, vibrations between the dog device 15 and the wall are essentially avoided. Because of this, and also because the dog device 15 consists of a rubber body, damages on the wall caused by the dog device are essentially avoided, damages which otherwise can be substantial in the case of certain types of wall materials. For the same reason damaging the dog device is also essentially avoided or the wear of the dog device can be reduced.

Thereafter the operator can return to an essentially horizontal working position of the guide bar 6, possibly alternating with an upraised working position. FIG. 8 illustrates a moment when the kerf 50 has advanced downwards a certain length in the wall and the machine has been pivoted to a downward directed working position. The kerf 52, which is shaped as a segment of a circle, indicates the bottom of a kerf portion which has been formed by the saw chain in the region of the tip portion of the guide bar. The machine according to the invention allows a turning of the machine in the plane of the guide bar up to 40–50° when sawing in a flat wall. Typically, the machine is operated with angles of rotation up to about 30°. In the next moment of operation, the remaining, more or less triangular portions 53 and 54 can be sawn through with the saw bar in a horizontal position. Due to the fact that the pathway of the chain through these triangular portions is shorter than the thickness of the wall, also in this case the contact pressure of the saw chain is augmented as compared with sawing through the whole thickness of the wall in case of equal pressure force applied by the operator. When thus the line 55 has been reached, the operation which is illustrated in FIG. 8, i.e. pivoting the guide bar along a sector of a circle having a centre defined by the dog device 15, can be repeated. In this way the sawing can proceed through pivoting movements alternating with straight downwards directed working movements of the machine. It should be realised that the high location of the dog device 15 in combination with a positioning which does not restrict the working depth of the saw, allow very substantial pivoting action causing a very efficient sawing.

The invention claimed is:

1. A portable motor chain saw comprising a machine body with a driving unit, a rear handle, a front handle which extends over the machine body, a guide bar and a dog device provided such that it can be pressed against an object to be worked by means of the chain saw, said dog device forming a centre of rotation for turning the guide bar in the plane of the guide bar, wherein the dog device is provided in front of the front handle, approximately on a level with that part of the front handle which extends over the machine body, and is connected to the front handle, and wherein at least that part of the dog device which is provided to engage the object to be worked, consists of a polymeric material.

2. The motor chain saw according to claim 1, wherein the polymeric material consists of rubber.

3. The motor chain saw according to claim 1, wherein the dog device is mounted on a hand guard, which is mounted on the front handle.

4. The motor chain saw according to claim 3, wherein the dog device is rigidly mounted on the hand guard such that it extends at least a bit along and a distance from that part of the front handle which extends over the machine body.

5. The motor chain saw according to claim 3, wherein the dog device consists of a rubber body mounted on the front side of the hand guard.

6. The motor chain saw according to claim 3, wherein the hand guard is mounted on a portion of the front handle which extends along the right hand side of the machine body via a mounting arm which extends forwards upwards, that the hand guard extends from said mounting arm along and at a distance from that part of the front handle which extends over the machine body, and wherein said dog device is provided on the hand guard, adjoining the mounting arm.

7. The motor chain saw according to claim 6, wherein a water channel extends through the hand guard in or adjacent to the mounting arm, that a control valve is provided in the water channel, and wherein a control for the valve is provided adjacent to the right hand portion of the front handle.

8. The motor chain saw according to claim 6, wherein said portion of the front handle is provided with a forward projecting mounting bracket, which extends into a securing pocket in the hand guard and is connected to said securing pocket by at least one screw.

9. The motor chain saw according to claim 3, wherein the hand guard consists of a plastic material.

10. The motor chain saw according to claim 1, wherein said dog device is mounted such that a conceived vertical line from the front side of the dog device intersects a horizontal plane which coincides with the centre line of the guide bar in or adjacent to the plane which is defined by the front side of the machine body in the region of the guide bar.

11. The motor chain saw according to claim 1, wherein the front handle is devibratedly mounted on the machine body.

12. The motor chain saw according to claim 11, wherein The dog device is rigidly connected to the devibratedly mounted front handle.

13. The motor chain saw according to claim 1, wherein the dog device is devibratedly connected to the front handle.

14. The motor chain saw according to claim 13, wherein the front handle is rigidly mounted on the machine body.

15. The motor chain saw according to claim 1, wherein the height of the dog device over the guide bar corresponds to two to three times the length of the vertical width of the guide bar.

16. The motor chain saw according to claim 1, wherein the dog device is located in the point of a conceived triangle having a first corner in the region of the front side of the dog device, a second corner in the rear end of the rear handle, and a third corner on the bottom side of the guide bar adjacent to the tip of the guide bar, and wherein the angle of the triangle in said second corner amounts to between 25 and 45°.

17. The motor chain saw according to claim 16, wherein said triangle is an essentially isosceles triangle having its top in said first corner.

18. The motor chain saw according to claim 16, wherein the angle of the triangle in said second corner amounts to between 30 and 40°.

* * * * *